United States Patent [19]

Sandy

[11] 4,215,997

[45] Aug. 5, 1980

[54] FUEL COMPOSITIONS CONTAINING TETRACOORDINATED COBALT COMPOUNDS

[75] Inventor: Charles A. Sandy, Wilmington, Del.

[73] Assignee: E. I. Du Pont de Nemours & Co., Wilmington, Del.

[21] Appl. No.: 56,217

[22] Filed: Jul. 10, 1979

[51] Int. Cl.[2] ..... C10L 1/30

[52] U.S. Cl. ..... 44/68; 252/386; 44/69

[58] Field of Search ..... 44/68, 69; 252/386

[56] References Cited

U.S. PATENT DOCUMENTS

| | | | |
|---|---|---|---|
| 2,023,372 | 12/1935 | Max . | |
| 2,086,775 | 7/1937 | Lyons et al. . | |
| 2,235,466 | 5/1941 | Van Peski et al. . | |
| 2,737,932 | 3/1956 | Thomas . | |
| 2,902,983 | 9/1959 | Patberg . | |
| 3,088,960 | 5/1963 | Wollensak | 44/68 |
| 3,088,961 | 5/1963 | Wilkinson | 44/68 |
| 3,113,145 | 12/1963 | Wilkinson | 44/68 |
| 3,141,031 | 7/1964 | Wilkinson | 44/68 |
| 3,157,682 | 11/1964 | Ramsden | 44/68 |

FOREIGN PATENT DOCUMENTS 287192 3/1928 United Kingdom .

OTHER PUBLICATIONS

Studies of the Planar-Tetrahedral Configurational Equilibrium in Solution of bis($\beta$-ketoamino)cobalt (II) Complexes, Holm et al., 12/27/65.

*Primary Examiner*—Patrick Garvin
*Assistant Examiner*—Harris-Smith Y.
*Attorney, Agent, or Firm*—James A. Costello

[57] ABSTRACT

Hydrocarbon fuel compositions containing at least one divalent tetracoordinated cobalt compound represented by the structure

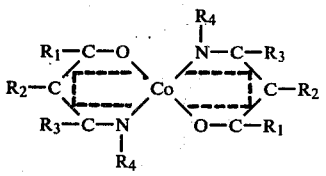

wherein:

$R_1$, $R_2$ and $R_3$ are each independently selected from hydrogen and $C_{1-6}$ alkyl, and $R_4$ is a branched $C_{3-6}$ alkyl wherein the branching is on either or both of the number 1 and 2 carbon atoms of said alkyl group.

10 Claims, No Drawings

FUEL COMPOSITIONS CONTAINING TETRACOORDINATED COBALT COMPOUNDS

BACKGROUND OF THE INVENTION

This invention concerns hydrocarbon fuel compositions containing divalent tetracoordinated cobalt complexes, referred to for simplicity as Co(II) bis(β-acetyl-N-alkylvinylimines).

One of the most important performance properties of a gasoline for internal combustion engines is its antiknock quality. Antiknock quality determines the maximum power, efficiency, and economy that an engine can provide.

Antiknock quality, indicated by the octane number of a gasoline, can be improved by increasing the amount of high octane quality hydrocarbons such as benzene, toluene, etc. in the gasoline. However, because of their flexibility and economy, antiknock additives such as tetraalkyllead compounds have been used regularly by gasoline refiners to improve antiknock quality of hydrocarbon fuels.

With the advent of automobiles equipped with catalytic converters for exhaust emission control purposes has come the attendant requirement for lead-free gasolines. Reliance upon blending more of the high octane hydrocarbon components to improve the octane quality of the fuel is uneconomical since these hydrocarbon components are more valuable when utilized as solvents and as chemical feedstocks in the petrochemical industry.

Numerous nonlead antiknock additives, both metal-containing and metal-free, have been suggested in the art but have not attained practical significance because of insufficient antiknock activity, hydrolytic or oxidative instability, insufficient solubility or combinations of these deficiencies. Accordingly, there is a need for an effective and stable non-lead octane improving additive for the production of lead-free gasolines of good antiknock quality.

Cobalt-containing compounds are known for use in internal combustion engines as antiknocks, antipreignition agents and the like. Disclosures of such cobalt-containing compounds can be found in U.S. Pat. Nos. 2,023,372; 2,086,775; 2,737,932; 2,902,983; and 2,235,466, and in British Pat. No. 287,192. These patents do not, however, suggest the particular cobalt-containing compounds employed in this invention.

The complexes described herein are known from Everett and Holm, J. Am. Chem. Soc. 88 2442 (1966). Nowhere in the art, however, is there any suggestion that the Everett and Holm complexes might be useful as antiknock agents. More importantly, there is no suggestion that such compounds would be characterized by good antiknock activity, good hydrolytic and oxidative stability, and good solubility in hydrocarbon fuels.

SUMMARY OF THE INVENTION

This invention concerns hydrocarbon fuel compositions comprising liquid hydrocarbons boiling in the range of about 20° C. to 400° C. and an amount to provide about 0.02 to 5 grams of cobalt metal per U.S. gallon of said hydrocarbon fuel composition of at least one divalent tetracoordinated cobalt compound represented by the structure

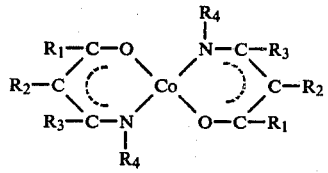

wherein:

$R_1$, $R_2$ and $R_3$ are independently selected from hydrogen and $C_{1-6}$ alkyl, and $R_4$ is a branched $C_{3-6}$ alkyl wherein the branching is on either or both of the number 1 and 2 carbon atoms of said alkyl group.

The $R_1$, $R_2$ and $R_3$ alkyl groups are selected from methyl, ethyl, propyl, butyl, pentyl and hexyl, as well as the corresponding isomeric alkyl groups such as isopropyl, tertiary butyl, neopentyl and the like. The preferred compounds have methyl, ethyl, isopropyl or tertiary butyl groups as $R_1$, and $R_2=R_3=$hydrogen.

The $R_4$ branched alkyl groups include 1-methylethyl-(isopropyl), 1-methylpropyl(sec.-butyl), 1,1-dimethylethyl(tert.-butyl), 2-methylpropyl(isobutyl), 1-methylbutyl, 1,2-dimethylpropyl, 2,2-dimethylpropyl(neopentyl), 1,1-dimethylpropyl(tert.-amyl), 1-methylpentyl, 1,2,2-trimethylpropyl and 1-methyl-1-ethylpropyl. The preferred cobalt complexes are those wherein $R_4$ is isopropyl or t-butyl, i.e., Co(II) bis(β-acetyl-N-isopropylvinylimine), and Co(II) bis(β-acetyl-N-t-butylvinylimine).

DETAILS OF THE INVENTION

The cobalt complexes are prepared from β-acetyl-N-alkylvinylamines represented by the formula

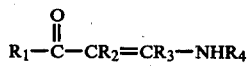

wherein $R_1$, $R_2$, $R_3$ and $R_4$ are as defined. The β-acyl-N-alkylvinylamines are known and can be prepared, for example, by the method of Benary, *Berichte* 63 1573 (1930). Briefly, that method involves condensation of a sodium salt of a β-dicarbonyl compound with a salt of an amine in an inert solvent such as absolute alcohol.

The cobalt complexes are prepared by condensing the appropriate β-acyl-N-alkylvinylamine with bis(tetraalkylammonium)tetrabromocobaltate, $(R_4N)_2CoBr_4$, under anaerobic and anhydrous conditions as described by Everett and Holm, J. Am. Chem. Soc. 88 2442, (1966). Preparation A, infra, was conducted basically according to the Everett and Holm procedure. The $(R_4N)_2CoBr_4$ can be prepared according to the procedure of Inorganic Synthesis, Volume IX, page 140, S. Y. Tyree, Jr. Ed. McGraw-Hill, N.Y. 1967, which preparation involves mixing cobaltous bromide with two molar equivalents of tetraalkylammonium bromide in absolute alcohol.

In the cobalt compounds described and depicted herein, the broken line curve within each of the six-membered rings represents resonating structures of the β-acyl-N-alkylvinylamine anion. By resonating structures of the β-acyl-N-alkylvinylamine anion is meant that the actual structure is a hybrid structure of the two more important anion structures

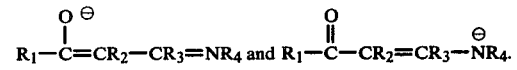

For simplicity, the cobalt complexes can be referred to as Co(II) bis(β-acyl-N-alkylvinylimines) wherein Co(II) designates a divalent cobalt metal ion and β-acyl-N-alkylvinylimine refers to the anion of β-acyl-N-alkylvinylamine.

The hydrocarbon fuels into which the cobalt complexes are incorporated to improve their combustion characteristics include petroleum hydrocarbons such as motor gasoline, aviation gasoline, jet fuel, diesel fuel, light distillates, fuel oil, gas oil and the like. Improved combustion characteristics lie in the areas of antiknock efficiency, modified combustion chamber deposits, octane requirement increase control, reduced smoke, reduced carbon formation and the like. The cobalt complexes are characterized by good fuel solubility and by good hydrolytic and oxidative stability.

The motor gasolines are generally mixtures of paraffinic, olefinic, cycloaliphatic and aromatic hydrocarbons including such fractions and refinery products obtained by distillation, cracking, reforming, alkylation and polymerization processes. Normally, gasolines boil in the range of about 20° C. to 225° C. The fuel can also contain other additives normally used in commercial gasolines such as detergents, oxidation inhibitors, gum inhibitors, anti-icing additives, metal deactivators, dyes, solvents and the like.

In lead-free gasolines designed for use in catalyst-equipped automobiles, the octane number improvement desired over the base gasoline is usually up to about 3 Research Octane Numbers and thus the gasoline will contain about 0.025 to 0.3 gram of cobalt per gallon. Higher concentrations of cobalt can be used to obtain even greater octane improvement.

The cobalt complexes described herein can also be employed in gasolines containing lead antiknock compounds to provide additional improvements in octane numbers. Such gasolines can contain about 0.1 to 3 grams of lead metal and about 0.02 to 5 grams of cobalt metal per gallon. The lead antiknock compound can be tetraethyllead, tetramethyllead, mixtures of tetraethyllead and tetramethyllead or redistributed mixtures of tetraethyllead and tetramethyllead. The lead antiknock-containing gasoline can also contain scavengers normally used with lead antiknocks such as ethylenedichloride, ethylenedibromide or mixtures of these.

Preparation A—Co(II) bis(β-acetyl-N-isopropylvinylimine)

A five liter reaction flask equipped with a thermometer, an agitator, a condenser, an addition funnel and a nitrogen sweep system was dried by heating the flask under a dry nitrogen sweep. Dry tertiary butyl alcohol (2800 ml) containing 154.9 g of potassium tertiary butoxide was added to the flask, heated to 50° C. and β-acetyl-N-isopropylvinylamine (139.9 g), prepared according to Benary, Berichte 63 1573 (1930), was added. Over a period of about 1 hour, bis(tetraethylammonium)tetrabromocobaltate (539 g), prepared according to Inorganic Synthesis, Volume IX, page 140, was added while maintaining the reaction temperature at 50° C. After 2 hours at 50° C., the contents of the flask was allowed to cool to room temperature and agitation was continued for about 15 hours. The contents of the flask was filtered under nitrogen atmosphere and the precipitate was washed with dry tertiary butyl alcohol (800 ml).

The combined filtrate was concentrated at 20 to 40 mm pressure and 40° to 50° C. to a semisolid brown mass. The semisolid mass was dissolved in 1500 ml of n-heptane by heating under a nitrogen atmosphere. The heptane solution was filtered, cooled in an ice bath and again filtered giving 97.5 g (57% theory) of Co(II) bis(β-acetyl-N-isopropylvinylimine) as a red solid melting in the range of 120.5° to 121° C. An additional 21 g of the product was obtained by cooling the above filtrate in a dry ice-acetone bath and filtering. The cobalt(II) bis(β-acetyl-N-isopropylvinylamine) was stable to air oxidation both as a solid and as a solution. The following elemental analyses were obtained: carbon, 54.7%; hydrogen, 7.7%; nitrogen, 9.0%; and cobalt, 18.7%. Theoretical values for Co(II) bis(β-acetyl-N-isopropylvinylimine) are: carbon, 54.1%; hydrogen, 7.7%; nitrogen, 7.7% and cobalt, 18.6%.

Using the procedure essentially as described above, the following CO(II) bis(β-acyl-N-alkylvinylimines) were prepared:

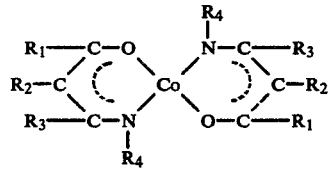

| Preparation | $R_1$ | $R_2$ | $R_3$ | $R_4$ | Stability to Air |
|---|---|---|---|---|---|
| B | $CH_3$ | H | H | $C(CH_3)_3$ | good |
| C | $(CH_3)_3C$ | H | H | $C(CH_3)_3$ | good |

In addition, the following complexes excluded from the scope of this invention by reason of the unbranched character of $R_4$ were also prepared by the procedure of Preparation A:

| Preparation | $R_1$ | $R_2$ | $R_3$ | $R_4$ | Stability to Air |
|---|---|---|---|---|---|
| X | $CH_3$ | H | H | $C_2H_5$ | poor |
| Y | $CH_3$ | H | H | $CH_3$ | v. poor |

Thermogravimetric characterizations were made of the cobalt complexes of Preparations A, B, X and Y using a Du Pont 990 Thermal Analyzer coupled to a Du Pont 951 Thermogravimetric Analyzer. A 20 mg sample of the cobalt complex was heated over a temperature range of 25° to 500° C. at a heating rate of 5° C./minute with either nitrogen or air as the carrier gas at a gas flow rate of 40 ml/minute. The analysis with nitrogen as the carrier gas indicates thermal stability of the cobalt complex whereas the analysis with air as the carrier gas indicates thermal and oxidative stabilities. Both the complexes of Preparation A ($R_1=CH_3$, $R_2=R_3=H$ and $R_4=CH(CH_3)_2$) and Preparation B ($R_1=CH_3$, $R_2=R_3=H$ and $R_4=C(CH_3)_3$) were found to be oxidatively and thermally stable. With either nitrogen or air as the carrier gas, the complex of Preparation A showed initiation of volatilization at about 125° C. and complete volatilization at about 210° C. With the complex of Preparation B, volatilization was initiated at about 155° C. and was completed at about 240° C. The results showed that the complex of Preparation X ($R_1=CH_3$, $R_2=R_3=H$ and $R_4=C_2H_5$) was thermally stable with volatilization initiated at about 75° C. and completed at about 220° C. With air as the carrier gas, oxidative degradation of the complex of Preparation X took place at about 200° C. with about 60% of the sample volatilized. The complex of Preparation Y ($R_1=CH_3$, $R_2=R_3=H$ and $R_4=CH_3$) underwent oxidative degradation upon exposure to air at room temperature.

The following Examples illustrate the invention.

EXAMPLES 1 AND 2

The ability of the disclosed cobalt complexes to increase octane numbers was determined in a lead-free motor gasoline having the following characteristics:

| | |
|---|---|
| Composition: | |
| saturated hydrocarbons, volume percent | 61 |
| olefinic hydrocarbons, volume percent | 8 |
| aromatic hydrocarbons, volume percent | 31 |
| Distillation (ASTM D-86): | |
| | °C. (to nearest whole degree) |
| Initial Boiling Pt. | 38 |
| 5 | 53 |
| 10 | 62 |
| 30 | 97 |
| 50 | 122 |
| 70 | 144 |
| 90 | 179 |
| 95 | 201 |
| Max. Temp. | 219 |
| Recovery, volume percent | 98 |
| Residue, volume percent | 1 |
| Reid Vapor Pressure (ASTM D-323) | lb. 7.9 |
| Induction Period (ASTM D-525) | no break |
| Sulfur (ASTM D-3120) weight percent | 0.034 |
| | °C. |
| Octane Rating | |
| Research Octane Number (RON) | 91.4 |
| Motor Octane Number (MON) | 82.0 |
| (RON + MON)/2 Octane Number | 86.7 |

The octane numbers of the fuels were determined by the Research Method (ASTM D-909) and the Motor Method (ASTM D-357). Generally, Research Octane Number (R) is considered to be a better guide of antiknock quality of fuels when vehicles are operated under mild conditions associated with low speeds while the Motor Octane Number (M) is considered to be a better indicator when operating a vehicle at high engine speed or under heavy load conditions. For many engine operating conditions, some intermediate value between the Research and the Motor Octane Numbers such as an average provide the best indication of the antiknock quality of the fuel.

To separate portions of the base fuel were added cobalt(II) bis(β-acyl-N-alkylvinylimine) complexes in the amount to provide cobalt metal concentrations as indicated in Table 1 below. The knock ratings for the fuel blends were determined in duplicates on duplicate samples. The results are summarized below wherein the antiknock quality improvements are provided in terms of increase in the octane numbers (ΔO.N.) over the Research, Motor and (R+M)/2 octane numbers of the base fuel.

In Example 1, the cobalt complex is that of Preparation A; in Example 2, that of Preparation B; and in the Comparative Example, that of Preparation X.

Table 1

| Cobalt g/gal | Antiknock Response Increase in Octane Number (ΔO.N.) Research | Motor | (R + M)/2 |
|---|---|---|---|
| Example 1 (Compound = Co(II) bis(β-acetyl-N-isopropylvinylimine) | | | |
| 0.025 | 0.2 | 0.2 | 0.2 |
| 0.05 | 0.9 | 0.5 | 0.7 |
| 0.10 | 1.9 | 1.0 | 1.5 |
| 0.15 | 2.3 | 1.3 | 1.8 |
| 0.20 | 2.9 | 1.1 | 2.0 |
| 0.25 | 3.3 | 1.3 | 2.3 |
| 0.30 | 3.1 | 1.5 | 2.3 |
| Example 2 (Compound = Co(II) bis(β-acetyl-N-tert.-butylvinylimine) | | | |
| 0.025 | 0.2 | 0.2 | 0.2 |
| 0.05 | 0.6 | 0.4 | 0.5 |
| 0.10 | 1.7 | 1.0 | 1.3 |
| 0.15 | 2.1 | 1.1 | 1.6 |
| 0.20 | 2.3 | 1.2 | 1.8 |
| 0.25 | 2.8 | 1.4 | 2.1 |
| 0.30 | 3.0 | 1.5 | 2.3 |
| Comparison Example Compound = Co(II) bis(β-acetyl-N-ethylvinylimine) | | | |
| 0.025 | 0.2 | 0.2 | 0.2 |
| 0.05 | 0.5 | 0.2 | 0.3 |
| 0.10 | 1.5 | 0.6 | 1.0 |
| 0.15 | 1.7 | 0.8 | 1.3 |
| 0.20 | 2.0 | 0.9 | 1.5 |
| 0.25 | 2.2 | 1.2 | 1.7 |
| 0.30 | 2.3 | 0.9 | 1.6 |

Examples 1 and 2 responses show that Co(II) bis(β-acetyl-N-alkylvinylimine) complexes wherein the alkyl substituent on the nitrogen is a branched alkyl group provide superior octane improvement over the comparative cobalt complex with a straight-chain substituent on the nitrogen.

Thus, comparison of the increases in Research Octane Numbers obtained using the compound of the Comparison vs. those obtained using the compound of Example 1 shows that the compound of the Comparison gives results, on the average, only about 75% of those obtained with the compound of Example 1. The compound of the Comparison gives results only about 85% of those obtained with the compound of Example 2. These results were computed from the increase in antiknock response (RON) obtained at each cobalt concentration in the Table when using the compound of the Comparison divided by the increase obtained when using the compound of Example 1 and Example 2.

For an additional examination of the importance of the differences in Research Octane Number increases obtained with the Comparison Compound versus the increases obtained with the compound of Example 1, see the discussion following Table 2.

The differences are more particularly noticeable when the improvements in Motor Octane Numbers are compared. This deficiency in Motor Octane Number improvement of the complex of Preparation X is believed to be due to its lower oxidative stability under the more severe operating conditions of the Motor Method. Because of its better volatility as indicated by the thermogravimetric analyses described above, it would normally be expected that the complex of Preparation X would be a more effective antiknock additive than those of Preparations A and B. Thus, the discovery that the less volatile complexes (where $R_4$ is a branched chain alkyl group) give better antiknock improvement is a surprising one.

EXAMPLE 3

In another series, antiknock performances of the complexes of Preparations A (Example 3) and X (Comparison Example) were determined using a modified Research Octane Number Method. The modification consisted of using fuel injection in place of the usual carburetion, all other conditions remaining the same. In this modification, fuel is injected directly into the combustion chamber of the engine and is therefore not exposed to air and moisture in the induction system as in the usual carburetion procedure. The value of using the modified method is that if the results obtained thereby are better than the results obtained by the usual carburetion procedure, it indicates that the failure of an antiknock additive to provide its full potential as an octane number improver by the normal method is due to its oxidative or hydrolytic instability in the environment of the induction system of the carburated engines. See Table 2.

The base fuel used in these Examples had the following characteristics:

| | |
|---|---|
| Composition: | |
| saturated hydrocarbons, volume percent | 65 |
| olefinic hydrocarbons, volume percent | 9 |
| aromatic hydrocarbons, volume percent | 26 |
| Distillation (ASTM D-86) | |
| | °C. (to nearest whole degree) |
| Initial Boiling Pt. | 41 |
| 10% | 59 |
| 50% | 94 |
| 90% | 154 |
| Max. Temp. | 176 |
| Recovery, volume percent | 97 |
| Residue, volume percent | 1 |
| | °C. |
| Reid Vapor Pressure (ASTM D-323) | |
| lb | 8.6 |
| Sulfur (ASTM D-3120) weight | |
| percent | 0.002 |
| Octane Rating | |
| Research Octane No. | 96.9 |
| Motor Octane No. | 82.7 |
| (R + M)/2 Octane No. | 86.8 |

Table 2

| Cobalt g/gal | Antiknock Response by Fuel Injection Method: Increase in Octane Number (Δ O.N.) Research |
|---|---|
| Example 3 Compound = Co(II) bis(β-acetyl-N-isopropylvinylimine) | |
| 0.25 | 2.7 |
| 0.50 | 4.0 |
| 0.75 | 5.2 |
| 1.0 | 5.9 |
| 2.0 | 8.4 |
| 3.0 | 10.4 |
| Comparison Example Compound = Co(II) bis(β-acetyl-N-ethylvinylimine) | |
| 0.25 | 2.5 |
| 0.50 | 3.8 |
| 0.75 | 4.6 |
| 1.0 | 5.6 |
| 2.0 | 7.8 |
| 3.0 | 9.7 |

It can be seen from Table 2 that the branched chain complex of Preparation A provides superior antiknock activity when compared to the unbranched complex of Preparation X using a fuel injection procedure.

As discussed following Table 1, the data summarized therein show that in a carbureted engine, Co(II) bis(β-acetyl-N-ethylvinylimide) of the Comparison has, on the average, only about 75% of the Research Octane Number improving efficiency of the compound of Examples 1 and 3, Co(II) bis(β-acetyl-N-isopropylvinylimine) on a comparable metal weight basis. The data summarized in Table 2 show that when the fuel is injected directly into the combustion chamber, the compound of the Comparison exhibits on the average, 93% of the Research Octane Number improving efficiency of the compound of Examples 1 and 3. This depreciation of relative efficiency of about 93% down to 75% of the compound of the Comparison relative to the compound of Examples 1 and 3 (in going from the fuel injection engine to the carbureted engine) is attributed to the increased degradation of the compound of the Comparison in the induction system of the carbureted engine due to its relatively low oxidative stability and possibly also due to its relatively low hydrolytic stability.

The embodiments of the invention in which an exclusive property or privilege is claimed are defined as follows:

1. A hydrocarbon fuel composition comprising liquid hydrocarbons boiling in the range of about 20° C. to 400° C., and an amount to provide about 0.02 to 5 grams of cobalt metal per gallon of said hydrocarbon fuel composition of at least one divalent tetracoordinated cobalt compound represented by the structure

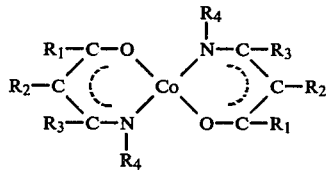

wherein:

$R_1$, $R_2$ and $R_3$ are independently selected from hydrogen and $C_{1-6}$ alkyl, and $R_4$ is a branched $C_{3-6}$ alkyl wherein the branching is on either or both of the number 1 and 2 carbon atoms of said alkyl group.

2. The composition according to claim 1 wherein said hydrocarbon components are hydrocarbons boiling in the gasoline boiling range of about 20° C. to 225° C.

3. The composition according to claim 2 wherein $R_1$ is methyl, ethyl, isopropyl or tertiary butyl and $R_2=R_3=$hydrogen.

4. The composition according to claim 3 wherein $R_1$ is methyl, isopropyl or tertiary butyl.

5. The composition according to claim 1 wherein $R_4$ is isopropyl or tertiary butyl.

6. The composition according to claim 2 wherein $R_4$ is isopropyl or tertiary butyl.

7. The composition according to claim 3 wherein $R_4$ is isopropyl or tertiary butyl.

8. The composition according to claim 4 wherein $R_4$ is isopropyl or tertiary butyl.

9. The composition according to claim 1 wherein $R_1=$methyl, $R_2=R_3=$hydrogen, and $R_4=$isopropyl or tertiary butyl.

10. The composition according to claim 9 wherein $R_1=$methyl, $R_2=R_3=$hydrogen, and $R_4=$isopropyl.

* * * * *